United States Patent [19]

Wildi et al.

[11] Patent Number: 4,535,956

[45] Date of Patent: Aug. 20, 1985

[54] THREAD BRAKING MECHANISM

[75] Inventors: Edwin Wildi, Niederuzwil; Erwin Bossart, Flawil; Hans Hasler, Uzwil, all of Switzerland

[73] Assignee: Maschinenfabrik Benninger AG, Uzwil, Switzerland

[21] Appl. No.: 647,369

[22] Filed: Sep. 4, 1984

[30] Foreign Application Priority Data

Sep. 14, 1983 [CH] Switzerland ..... 5005/83

[51] Int. Cl.[3] ..... B65H 59/16; B65H 59/22

[52] U.S. Cl. ..... 242/151

[58] Field of Search ..... 242/151, 152, 155 R, 242/147 R, 149, 131, 131.1, 75.2; 226/195

[56] References Cited

U.S. PATENT DOCUMENTS 3,999,724 12/1976 Haring et al. ..... 242/151

FOREIGN PATENT DOCUMENTS 2349334 4/1975 Fed. Rep. of Germany .
2531971 9/1976 Fed. Rep. of Germany .
2534364 2/1977 Fed. Rep. of Germany .

*Primary Examiner*—Stanley N. Gilreath

*Attorney, Agent, or Firm*—Werner W. Kleeman

[57] ABSTRACT

In a housing, two rollers having substantially parallel axes are freely rotatably journaled and bound between them a clamping bite. The thread to be braked is drawn through the clamping bite and thereby drives the rollers. A first of the two rollers is stationarily mounted in the housing. The second roller comprises a cover made of a rubber-elastic material. This second roller is journaled in a pivotable forked lever which is under the action of an angle lever. The second roller can be pressed against the stationary first roller with an adjustable operating bias by means of the angle lever and a force accumulator constituted by a tension spring. Spring means of a rapid braking device constitute a compression spring supported by a braking rod which is axially displaceable between two end positions. The compression spring acts upon a spring bush carrying a nose member. In one of the two end positions of the braking rod the nose member extends with play beneath an arm of the angle lever. In another one of the two end positions of the braking rod the nose member additionally transmits to this arm of the angle lever the force of the compression spring in order to initiate a rapid braking action of the two rollers.

9 Claims, 3 Drawing Figures

THREAD BRAKING MECHANISM

BACKGROUND OF THE INVENTION

The present invention relates to a new and improved construction of thread braking mechanism.

In its more particular aspects, the present invention relates to a new and improved construction of thread braking mechanism comprising two rollers or rolls which are substantially axially parallel arranged and freely rotatably journaled in a housing. These two rollers define therebetween a clamping bite or gap through which a thread or the like extends and which drives the two rollers while being drawn through the clamping bite. A first one of the two rollers constitutes a stationary roller and a second one of the two rollers is substantially axially parallel displaceable relative to the first stationary roller and can be resiliently pressed thereagainst with an adjustable bias or force. The thread braking mechanism further comprises a rapid braking device by means of which the adjusted bias is suddenly increased in order to initiate a rapid braking operation.

Thread braking mechanisms of this kind are known, for example, from German Patent Publication Nos. 2,531,971, 2,349,334 and 2,534,364. During operation thereof a continuous braking action on the thread is caused by the pressing work which has to be performed during the continuous deformation by the thread of a rubber-elastic covering which is present on at least one of the two rollers while the thread, which is intended to be braked, is approximately vertically drawn through the clamping bite or gap between the two rollers and thereby drives these two rollers.

Such thread braking mechanisms are predominantly employed, one for each thread, in combination with warp creels in which a multitude of threads or the like, while running off the creel, is intended to be braked without wear between their associated bobbins and a winding machine like, for example, a warping or beam warping machine. Generally, the pressure at which the displaceable second roller is pressed against the stationary first roller can be increased or decreased, and thus the braking action can be intensified or reduced in common for all of the thread braking mechanisms by central adjusting means.

At the high winding rates of modern equipment the relatively small rollers in such thread braking mechanisms attain very high velocities. When the equipment or installation is suddenly stopped or shut down, for example, in the case of a thread rupture or when encountering an emergency braking operation, these rollers still continue to run for a short period of time. There thus results a sagging of the threads, and thus, the danger of entanglements in the thread field which cause further thread ruptures or longer shut-down times and diminish the quality of the produced goods.

In order to counter this danger it is known to provide an additional rapid thread braking device which is activated within a short period of time when the machine is suddenly brought to a standstill and which additionally brakes the two rollers. German Patent Publication No. 2,531,971 discloses such a rapid braking device. In this device a compression spring generates the bias for the pair of rollers during normal operation and is rapidly and additionally tensioned by means of a piston-cylinder drive. A rapid braking of the rollers which are now pressed against each other at a significantly increased force and thus a rapid standstill of the rollers and of the thread are thereby achieved.

The known mechanism proposes to use the same spring for generating the bias of the rollers which has to be very finely adjusted as well as, by additionally tensioning the spring, for generating a stopping force which is appreciably massively increased as rapidly as possible above the aforementioned bias. Such use of the same spring for these two purposes is afflicted with considerable disadvantages. In the known mechanism the use of a compression spring which has a very small spring rate or constant is recommended in order to be able to sufficiently precisely uniformly adjust for all thread braking mechanisms even the smallest pressures desired during operation and acting between the two rollers without there becoming effective manufacturing tolerances. In correspondence therewith such a spring requires long displacement paths for achieving the additional stopping force required for the rapid braking operation. As is well known, the spatial conditions in the region of the thread braking mechanisms of a warp creel are very limited and these are undesired the presence of members or parts which impair the optical control of such locations. Furthermore, long displacement paths require correspondingly longer periods of time which, in turn, results in expensive constructions in order that the stopping force may become effective within the desired very small period of time. This is required because the standstill of the rollers should coincide with the standstill of the remaining equipment or installation, particularly of the winding machine. In this context it should be considered that, without further influence, the run-out of the rollers will be extensive at low thread tension, however, will be small at great thread tension.

SUMMARY OF THE INVENTION

Therefore, with the foregoing in mind, it is a primary object of the present invention to provide a new and improved thread braking mechanism containing a rapid braking device which reacts more rapidly and more reliably due to shorter displacement paths and shorter engagement times.

Another and more specific object of the present invention is directed to the provision of a new and improved thread braking mechanism containing a rapid braking device which has short displacement paths and short engagement times and which utilizes already existing parts of the thread braking device to a wide extent.

Now in order to implement these and still further objects of the invention, which will become more readily apparent as the description proceeds, the thread braking mechanism of the present development is manifested by the features that, the rapid braking device comprises an individual spring means operatively connected to the second displaceable roller. The individual spring means act upon the second displaceable roller by generating a stopping force for a rapid braking operation of the rollers independently of the action thereupon of the force accumulator which generates the operating bias or force for the second displaceable roller.

These measures now permit optimumly selecting the force accumulator for the sole purpose of generating a finely regulatable operating bias or force without considering the requirements of the rapid braking device. At the same time these measures also permit dimensioning the spring means generating the stopping force for a rapid braking operation in such a way as to be exclusively directed to this purpose.

In particular and in a preferred embodiment of the inventive thread braking mechanism, a tension spring having a very flat spring characteristic can be used as the force accumulator for generating the operating bias and the action of this tension spring can be very finely and very precisely adjusted. Contrary thereto, a compression spring having a relatively steep spring characteristic can be used for the spring means in the rapid braking device and such compression spring applies the required stopping force already after a small displacement path. Such a spring could not be used for generating the operating bias. However, as a force accumulator in the rapid braking device the compression spring permits, upon shut-down of the winding machine and simultaneous initiation of the rapid braking operation, the rollers of the thread braking mechanisms to be braked to standstill within a very short period of time.

In a preferred embodiment it is contemplated that the displaceable roller is pressed against the stationary roller by means of an angle lever which is mounted at the housing. The angle lever is acted upon by the force accumulator which generates the operating bias as well as, independently thereof, by the compression spring generating the stopping force. It is of a particular advantage that the compression spring generating the stopping force is supported with a first end thereof at a braking rod which is displaceable between two end positions and that a second end of the compression spring acts upon a spring bush or bushing which is slideably mounted at the braking rod. The spring bush or bushing carries a nose member or nose which extends with play beneath one arm of the angle lever in one of the two end positions of the braking rod and which transmits the stopping force of the compression spring to this arm of the angle lever in the other one of the two end positions of the braking rod.

A particularly simple construction is obtained by pressing the displaceable second roller against the stationary first roller with the operating bias, on the one hand, and with the stopping force, on the other hand, via the same angle lever. In such arrangement the function of the force accumulator which generates the operating bias or force remains unchanged during the momentary or transient superposition of the stopping force, and after termination of the rapid braking operation the original operational state is readjusted as before.

Preferably, the arrangement is additionally structured such that the support location or support of the compression spring is adjustable lengthwise of the braking rod and that a bias of the compression spring and/or the play between the nose member of the spring bush or bushing and the arm of the angle lever is adjustable by means of an adjustment member which is displaceable upon the braking rod and which acts as a stop for the spring bush or bushing. In this manner, the stopping force for each rapid braking device which is actuated by the braking rod, can be separately adjusted at each thread braking mechanism and also can be adapted to the operating conditions at any time. Notwithstanding the foregoing, there still exists the possibility of simultaneously actuating all the rapid braking devices of a warp creel by a centrally separate displacement or actuation of the braking rods.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
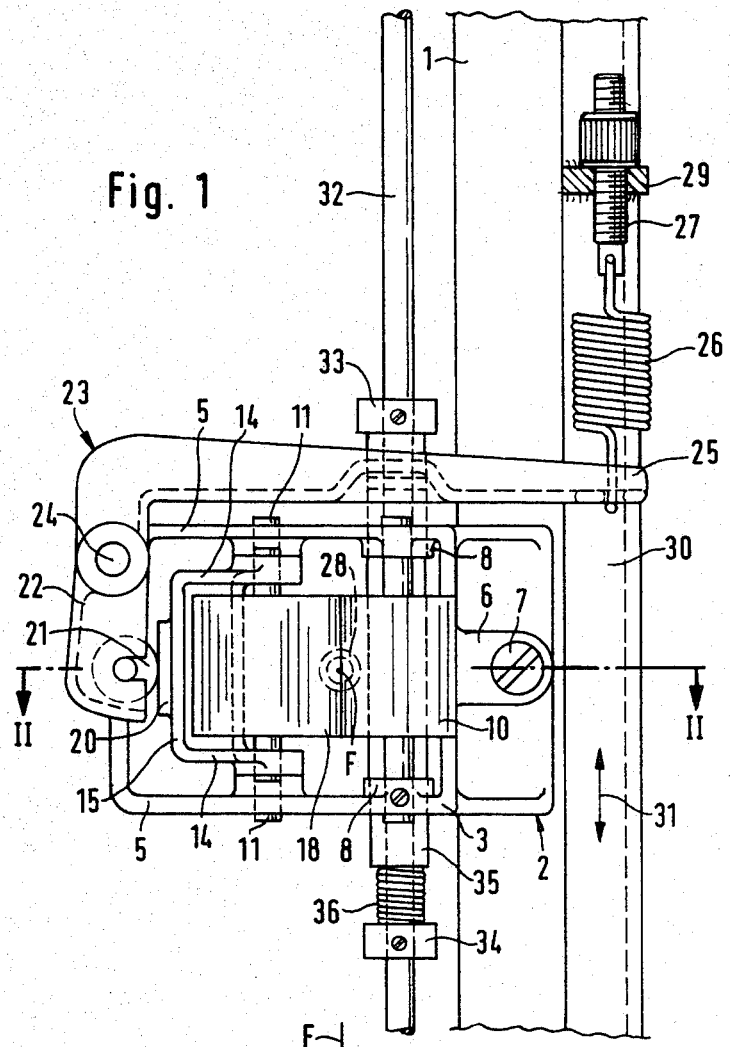
FIG. 1 is a partial view of a warp creel including a thread braking device according to the invention.
Figure 2:
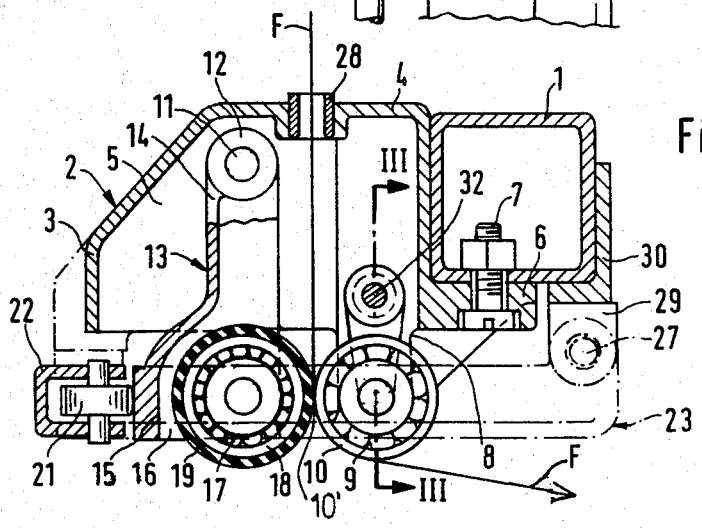
FIG. 2 is a cross-section through the thread braking device shown in FIG. 1 along the line II—II thereof.

Describing now the drawings, it is to be understood that only enough of the construction of the thread braking mechanism has been shown as needed for those skilled in the art to readily understand the underlying principles and concepts of the present development, while simplifying the showing of the drawings. Turning attention now specifically to FIG. 1, the thread braking device shown therein is one of a multitude of thread braking mechanisms which are arranged above each other in horizontal rows and vertical columns at a brake panel frame of a creel. FIGS. 1 and 2 show part of a brake panel stand or column which assumes the shape of a square tube and is designated by the reference numeral 1. The thread braking mechanism is generally designated by the reference numeral 2 and all these thread braking mechanisms are identical. Each thread braking mechanism 2 comprises a housing 3 with a rear wall 4 and end walls 5 which are arranged at the bottom and at the top. The housing 3 is secured at the brake panel stand 1 via a lug or boss 6 and by means of a bolt 7.

The two end walls 5 are each provided with a related tongue 8 and these two tongues 8 face each other. In the tongues 8 the journals of a roller 10 are journaled, preferably in ball bearings 9. In this manner, the roller 10 is stationarily and freely rotatably journaled at low friction in the housing 3 and constitutes a stationary first roller 10. Two openings are oppositely located in the end walls 5 and receive related axle pins 11 at which a forked or bifurcated lever 13 is freely suspendingly and freely pivotably mounted by means of eyes or eyelets 12 which are provided at the free ends of legs 14 of the forked or bifurcated lever 13. A web 15 of the forked or bifurcated lever 13 interconnects the two legs 14 thereof. At each of the two ends of the web 15 a related projection 16 protrudes therefrom, see FIG. 2, and the projections 16 receive therebetween related axle journals of a second roller 18. The axle journals of the second roller 18 are freely rotatably journaled at low friction in ball bearings 17. The size of the second roller 18 roughly corresponds to that of the first mentioned stationary first roller 10. This second roller 18 constitutes a displaceable roller which, due to the pivotable mounting of the forked or bifurcated lever 13, can be displaced substantially axially parallel relative to the stationary first roller 10. Contrary to the stationary first roller 10 which, in the illustrated embodiment contains a metallic surface without any coating or cover, the displaceable second roller 18 is provided with a coating or cover 19 made of a rubber-elastic or elastomeric material, preferably soft rubber.

Thread guide means are arranged forwardly and rearwardly of the pair of rollers 10 and 18 in order to guide the thread F which is withdrawn from the associated bobbin of the creel and which is intended to be braked by the thread braking mechanism 2. The thread F is guided through a clamping bite or gap 10' defined between the stationary first roller 10 and the displaceable second roller 18 and is guided practically at right angles to such clamping bite or gap 10'. In the drawing of FIG. 2 there are only shown the thread guiding or guide means which supply the thread F to the thread braking mechanism 2 as seen in the thread running direction and these thread guiding means have the design of a thread eye 28 which is inserted into an opening in the rear wall 4 of the housing 3. While passing through the clamping bite 10' defined by the two rollers 10 and 18, the thread F drives these rollers 10 and 18 and the thread F is thereafter deflected at the stationary first roller 10 and supplied in conventional manner to the not particularly illustrated winding machine which is associated with the creel and which may be, for example, a warping or beam warping machine.

A pressure plate 20 which cooperates with a pressing roller 21 is formed at the web 15 of the forked or bifurcated lever 13. The pressing roller 21 is journaled at a bifurcated end at a first arm 22 of an angle lever 23. The angle lever 23 is mounted for pivoting about an axis or pivot shaft 24 at the housing 3 of the thread braking mechanism 2. At the free end of the other or second arm 25 of the angle lever 23 there is anchored a first end of a force accumulator which here constitutes a tension spring 26. The second end of this tension spring 26 is anchored in an eyelet provided at the end of a fine adjustment screw 27. This fine adjustment screw 27 is threaded into a lug 29 which protrudes from a slide rail 30. The slide rail 30 carries in the same manner lugs and adjustment screws for the related tension springs of the further thread braking mechanisms of the creel.

By means of a not particularly illustrated central control the slide rail 30 is vertically adjustable, i.e. in the direction of the bidirectional arrow 31 in FIG. 1. As will be readily recognized, the force accumulator or tension spring 26 acts upon the angle lever 23, the roller 21 and the web 15, and thus, upon the displaceable second roller 18 in such a way as to displace this roller 18 relative to the stationary first roller in a substantially axially parallel manner and to resiliently press or bias the displaceable second roller 18 at its circumference against the circumference of the stationary first roller 10 with an operating bias which is adjusted at the force accumulator or tension spring 26. This regulation of the operating bias in the range of zero to a maximum value is commonly effected at all of the thread braking mechanisms by a corresponding upward or downward displacement of the slide rail 30. The regulating screw 27 permits a differentiated preadjustment at each individual thread braking mechanism 2 in order to compensate for eventually present differences in the thread tension which result from different positions of the thread braking mechanisms at the brake panel stand 1. A force accumulator or tension spring 26 which has a very flat spring characteristic is particularly suited for a precise and freely regulatable adjustment of the operating bias or force of the rollers 10 and 18.

During normal operation of the equipment or installation the threads are withdrawn by the winding machine from the bobbin locations of the creel at high velocity and the threads drive the rollers 10 and 18 during their passage through their related thread braking mechanisms 2. Depending on the operating bias which is generated by the position of the slide rail 30 and the force accumulator or tension spring 26, a pressing work is performed due to the greater or smaller deformation of the rubber-elastic cover 19 at the displaceable second roller 18 and which pressing work effects the desired braking or tensioning action upon the thread F between the related thread braking device 2 and the winding machine. At a sudden standstill or shut-down of the equipment or installation, for example, upon the occurrence of a thread rupture, the two rollers 10 and 18, in the absence of any special measures, would continue to run for a short time under the low operating bias which would result in a sagging of the threads.

In order to prevent this continued run of the rollers 10 and 18 there is advantageously provided a rapid braking device which is controlled by a stop signal for the equipment and which, when activated, generates a sudden and strong increase in the force by which the displaceable second roller 18 is pressed against the stationary first roller 10. The pressing work is thus strongly intensified and there results therefrom a strong braking action on the rollers 10 and 18 which thus rapidly come to standstill. Preferably, the standstill of the rollers 10 and 18, if possible, should coincide with the standstill of a winding drum of the winding machine which also still continues to run by a small amount. In such case any sagging of the threads could be prevented.

Figure 3:
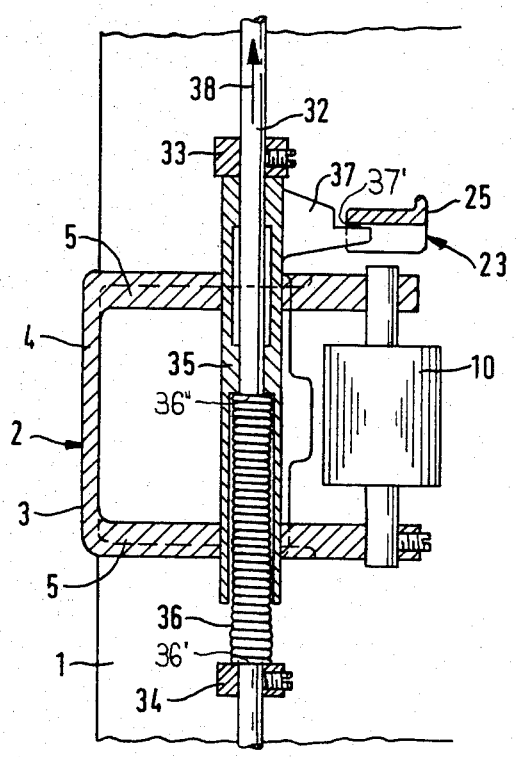
FIG. 3 is a section along the line III—III in FIG. 2.

The actuation of the rapid braking device in the thread braking mechanism according to the invention again is centrally controlled for all the thread braking mechanisms 2 by an axial displacement of a braking rod 32 which extends closely and parallel to the brake panel stand 1. As shown in FIG. 3, the braking rod 32 passes through the housings 3 of the related thread braking mechanisms 2. In the region of each thread braking mechanism 2 there are slipped onto the braking rod 32 an upper adjustment ring or adjustment member 33 and a lower adjusting ring or support 34. A spring bush or bushing 35 is slideably mounted at the braking rod 32 between the adjustment member 33 and the support 34. Spring means of the rapid braking device constitute a compression spring 36, a first end 36' of which is supported at the lower adjustment ring or support 34 and a second end 36'' of which acts upon the spring bush or bushing 35 in order to press the same against the upper adjustment ring or adjustment member 33, see FIG. 3. In FIG. 3 the braking rod 32 is shown in one of its two end positions which represents the normal position thereof in which a nose member or nose 37 which is carried by the spring bush or bushing 35 and which radially projects therefrom, extends with play 37' beneath the other or second arm 25 of the angle lever 23.

When, due to any possible event, the equipment is shut-down, then the braking rod 32 is simultaneously displaced into the other one of its two end or terminal positions, i.e. the braking rod 32 is upwardly displaced in the direction of the arrow 38 by a preadjustable amount of displacement. Conjointly with the movement of the braking rod 32, there are also displaced in the direction of the arrow 38 the upper adjustment ring or adjustment member 33, the lower adjustment ring or support 34, the compression spring 36 arranged therebetween, and the spring bush or bushing 35. The play 37' between the nose member 37 and the second arm 25 of the angle lever 23 is thus eliminated. Consequently, the second arm 25 of the angle lever 23 is upwardly subjected to the stopping force exerted by the compression spring 36. This stopping force is transmitted via the first arm 22 of the angle lever 23 and via the roller 21 to the displaceable second roller 18 of the two rollers 10 and 18 and is superimposed upon the operating bias or force already generated by the force accumulator or tension spring 26. Due to the thereby instantaneously intensified pressing work there is thus caused a very rapid standstill of the rollers 10 and 18.

By displacing the upper adjustment ring or adjustment member 33 at the braking rod 32 the bias of the compression spring 36 of the rapid braking device can be adjusted. By displacing the lower adjustment ring or support 34 at the braking rod 32 the stopping force generated by the compression spring 36 can be adjusted such that the rollers 10 and 18 come to a standstill practically simultaneously with the winding drum of the equipment or installation. By using separate force accumulators or springs which are independent of each other for generating the operating bias, on the one hand, and the stopping force, on the other hand, the most suitable expedients can be selected for each one of the aforementioned purposes. While a tension spring 26 having a relatively flat spring characteristic is selected for generating the operating bias for the reasons already mentioned hereinbefore, a compression spring 36 having a very steep spring characteristic can be utilized, which is particularly suited to generate a high stopping force within a short period of time after the shortest possible displacement and a correspondingly short engagement time.

The play 37' between the nose member 37 and the second arm 25 of the angle lever 23 can be adjusted in such a manner that in the normal operating position thereof an interference with the force application by the force accumulator or tension spring 26 to the displaceable second roller 18 can be excluded during normal operation by means of the upper adjustment ring or adjustment member 33 and the lower adjustment ring or support 34. At the same time, however, and via the adjustment of such play 37' the instant at which the nose member 37 contacts the second arm 25 of the angle lever 23 after a displacement of the braking rod 32 and thus the engagement time of the rapid braking device can be adjusted within certain limits.

At the initiation of stopping of the equipment, the slide rail 30 at first still remains in its operative position while the braking rod 32 is upwardly thrusted and generates the rapid braking action on the two rollers 10 and 18. After the rollers 10 and 18 have come to standstill, the braking rod 32 is returned into its starting position and the displaceable second roller 18 is thereby relieved from the additional stopping force of the compression spring 36. Advantageously, the slide rail 30 shown in FIG. 1 is downwardly displaced simultaneously therewith or shortly thereafter. Due to this displacement the second arm 25 of the angle lever 23 now is also relieved from the force generated by the force accumulator or tension spring 26 and bears upon the nose member 37. In this position of the angle lever 23 the roller 21 is disengaged from the web 15 of the forked or bifurcated lever 13 and any pressure which has existed between the two rollers 10 and 18 is thereby eliminated. There will result from such displacement a protection of the soft coating or cover 19 on the displaceable second roller 18 and also of the thread F which has a favorable affect particularly during longer periods of standstill.

While there are shown and described present preferred embodiments of the invention, it is to be distinctly understood that the invention is not limited thereto, but may be otherwise variously embodied and practiced within the scope of the following claims.

Accordingly, what we claim is:

1. A thread braking mechanism for thread comprising:

a housing;

two rollers substantially axially parallel and freely rotatably journaled in said housing;

said two rollers defining therebetween a clamping bite through which extends a thread which causes said two rollers to rotate while said thread is drawn through said clamping bite;

said two rollers comprising a stationary first roller and a displaceable second roller;

a force accumulator operatively connected to said displaceable second roller such as to displace said displaceable second roller relative to said stationary first roller in a substantially axially parallel manner and to resiliently press with an adjustable operating bias said displaceable second roller against said stationary first roller;

a rapid braking device comprising an individual spring means operatively associated with said displaceable second roller in order to suddenly increase the force acting thereupon for a rapid-braking operation; and said spring means, in an operative state of said rapid-braking device, subjecting said displaceable second roller to a stopping force in order to suddenly increase the force acting thereupon and to rapidly brake said two rollers independently of the action of said force accumulator which generates said operating bias.

2. The thread braking mechanism as defined in claim 1, wherein:

said force accumulator which generates said operating bias comprises a tension spring having a relatively flat spring characteristic.

3. The thread braking mechanism as defined in claim 1, wherein:

said spring means of said rapid-braking device constitute a compression spring having a relatively steep spring characteristic.

4. The thread braking mechanism as defined in claim 1, further including:

an angle lever pivotably mounted at said housing; and said angle lever being subjectable to said operating bias generated by said force accumulator and, independently thereof, to said stopping force generated by said spring means in order to press said displaceable second roller against said stationary first roller.

5. The thread braking mechanism as defined in claim 4, further including:

a forked lever freely suspendingly and pivotably mounted in said housing;

said displaceable second roller being rotatably journaled at said forked lever;

said angle lever defining a first arm; and said forked lever being operatively connected to said first arm of said angle lever.

6. The thread braking mechanism as defined in claim 5, further including:

a braking rod displaceable between two end positions;

said spring means of said rapid-braking device for generating said stopping force defining a first end and a second end;

said spring means being supported with said first end thereof at said braking rod;

a spring bush slideably mounted at said braking rod;

said spring means acting, with said second end thereof, upon said spring bush slideably mounted at said braking rod;

a nose member carried by said spring bush;

a second arm defined at said angle lever;

said nose member, in one of said two end positions of said braking rod, extending with play beneath said second arm of said angle lever and defining an end position thereof; and said nose member, in the other one of said two end positions of said braking rod, transmitting said stopping force generated by said spring means of said rapid braking device, to said second arm of said angle lever.

7. The thread braking mechanism as defined in claim 6, further including:

support means provided at said braking rod for supporting said spring means at said first end thereof;

said support means for said spring means being adjustable lengthwise of said braking rod;

an adjustment member displaceably mounted at said braking rod and acting as a stop means for said spring bush which is slideably mounted at said braking rod;

said spring means of said rapid-braking device having a bias which is adjustable by means of said adjustment member; and said adjustment member being displaceable at said braking rod in order to adjust said bias of said spring means.

8. The thread braking mechanism as defined in claim 6, further including:

support means provided at said braking rod for supporting said spring means at said first end thereof;

said support means for said spring means being adjustable lengthwise of said braking rod;

an adjustment member displaceably mounted at said braking rod and acting as a stop means for said spring bush which is slideably mounted at said braking rod; and said adjustment member being displaceable at said braking rod in order to adjust said play with which said nose member carried by said spring bush extends beneath said second arm of said angle lever in said one end position of said braking rod.

9. The thread braking mechanism as defined in claim 6, further including:

support means provided at said braking rod for supporting said spring means at said first end thereof;

said support means for said spring means being adjustable lengthwise of said braking rod;

an adjustment member displaceably mounted at said braking rod and acting as a stop means for said spring bush which is slideably mounted at said braking rod;

said spring means of said rapid-braking device having a bias which is adjustable by means of said adjustment member; and said adjustment member being displaceable at said braking rod in order to adjust said bias of said spring means and said play with which said nose member carried by said spring bush extends beneath said second arm of said angle lever in said one end position of said braking rod.

* * * * *